United States Patent [19]

Vickstrom

[11] 4,074,483

[45] Feb. 21, 1978

[54] APPARATUS FOR HOLDING PANELS IN A WINDOW CONSTRUCTION

[75] Inventor: Donald E. Vickstrom, Richmond, Va.

[73] Assignee: Reynolds Metals Company, Richmond, Va.

[21] Appl. No.: 768,069

[22] Filed: Feb. 14, 1977

[51] Int. Cl.[2] ..... E06B 3/28

[52] U.S. Cl. ..... 52/202; 49/61; 49/463; 160/90

[58] Field of Search ..... 52/202, 203; 49/61, 49/463; 160/89, 90

[56] References Cited

U.S. PATENT DOCUMENTS

| | | | |
|---|---|---|---|
| 2,631,340 | 3/1953 | Decker | 52/202 |
| 2,643,710 | 6/1953 | Sylvan | 160/90 |
| 2,667,245 | 1/1954 | Shink | 52/202 |
| 2,693,850 | 11/1954 | Skodnek | 160/90 |
| 2,702,595 | 2/1955 | Rumbaugh et al. | 160/90 |
| 2,723,732 | 11/1955 | Pettersen | 49/463 |
| 2,727,596 | 12/1955 | Smith | 160/90 |
| 2,761,498 | 9/1956 | Reinhardt | 160/90 |
| 2,857,963 | 10/1958 | Reinhardt | 160/90 |

FOREIGN PATENT DOCUMENTS

| | | | |
|---|---|---|---|
| 468,770 | 10/1950 | Canada | 160/90 |
| 475,397 | 7/1951 | Canada | 160/90 |

*Primary Examiner*—J. Karl Bell

*Attorney, Agent, or Firm*—Glenn, Lyne, Gibbs & Clark

[57] ABSTRACT

Apparatus for holding a plurality of three panels in a window construction is provided and comprises a horizontally disposed rail having a substantially U-shaped channel for receiving a lower end portion of a first panel therewithin with the U-shaped channel being defined by a horizontal bight and a pair of vertically disposed legs including an inner leg and an outer leg extending from opposite ends of the bight and an extension extending horizontally from the central part of the inner leg with the horizontal extension cooperating with a portion of the inner leg thereabove to define a first L-shaped channel for receiving a second of the three panels therewithin with the rail also having a second L-shaped channel disposed beneath the first L-shaped channel which is adapted to receive a third panel therewithin and the holding means also includes at least one F-shaped clip adapted to engage and hold upper portions of the first and second panels in position.

18 Claims, 6 Drawing Figures

APPARATUS FOR HOLDING PANELS IN A WINDOW CONSTRUCTION

BACKGROUND OF THE INVENTION

In recent years with the rapid increase in fuel cost there have been numerous efforts to conserve fuel by providing storm panels, and the like, over window openings; and, for dwellings which are not air conditioned screen panels are also provided with the storm panels. Because of the high costs, particularly labor costs, associated with professional installation of such storm and screen panels many home owners have attempted to construct and install their own panels. However, a problem with providing do-it-yourself panels of the character mentioned is the lack of simple and economical apparatus for holding such panels in position so that the storm panels and screen panels may be used and self stored in the usual manner.

SUMMARY

This invention provides an improved apparatus for holding a plurality of storm and screen panels in a window construction which is of simple and economical construction and is of the do-it-yourself type; and, such apparatus employs two basic structural shapes which are readily cut to length and installed in position to perform their function of holding a plurality of three associated panels in a window frame opening of the window construction.

The apparatus comprises a horizontally disposed rail having a substantially U-shaped channel for receiving a lower end portion of a first panel therewithin with the U-shaped channel being defined by a horizontal bight and a pair of vertically disposed legs including an inner leg and an outer leg extending from opposite ends of the bight and an extension extending horizontally from the central part of the inner leg with the horizontal extension cooperating with a portion of the inner leg thereabove to define a first L-shaped channel for receiving a second of the three panels therewithin with the rail also having a second L-shaped channel disposed beneath the first L-shaped channel which is adapted to receive a third panel therewithin; and, the holding means also includes at least one F-shaped clip adapted to engage and hold upper portions of the first and second panels in position.

Other details and advantages of the invention will become apparent as the following description of the embodiments thereof in the accompanying drawing proceeds.

BRIEF DESCRIPTION OF THE DRAWING

The accompanying drawing shows present preferred embodiments of the invention, in which.

DESCRIPTION OF ILLUSTRATED EMBODIMENTS

Figure 1:
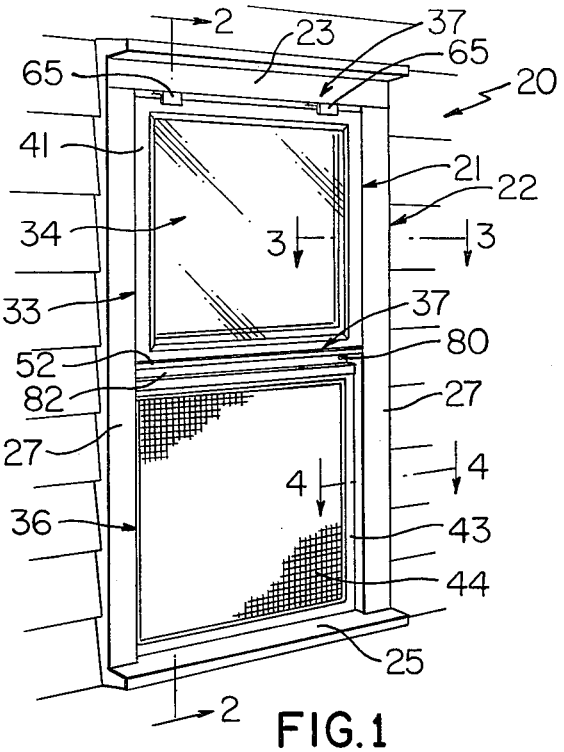
FIG. 1 is a fragmentary perspective view of a portion of a dwelling having a window frame opening defined therein and having a plurality of three panels installed within such opening with apparatus of this invention holding such panels in position.
Figure 3:
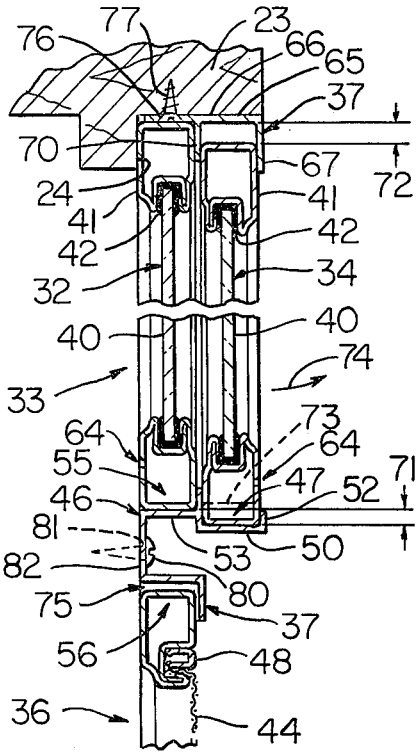
FIG. 3 is a cross-sectional view with portions broken away taken essentially on the line 3—3 of FIG. 1.
Figure 3:
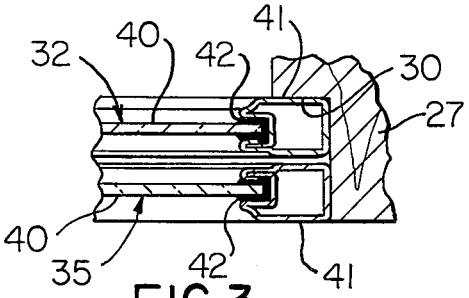
Figure 2:
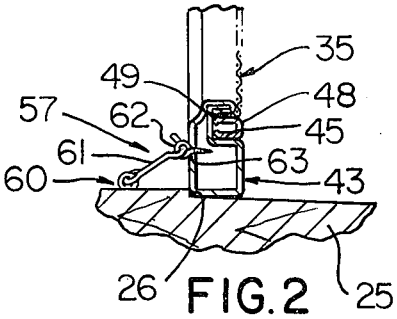
FIG. 2 is a cross-sectional view with portions broken away taken essentially on the line 2—2 of FIG. 1 particularly illustrating a central horizontal rail and an upper F-shaped clip of the apparatus.

Reference is now made to FIG. 1 of the drawing which illustrates a fragmentary portion of a dwelling which has a window construction 20 and window frame opening 21 defined therein by a plurality of peripheral framing members designated generally by the reference numeral 22. As seen in FIGS. 2 and 3, the framing members 22 include an upper member 23 having a vertically disposed supporting surface 24, a lower member 25 having a vertically disposed supporting surface 26 and a pair of spaced parallel side members each designated by the same reference numeral 27 and each having a vertically disposed supporting surface designated, in each instance, by the same reference numeral 30. The surfaces 26, 27 and 30 are disposed in a common plane and in this example of the invention such common plane is a substantially vertically disposed plane.

The opening 21 is particularly adapted to receive a plurality of three panels shown in FIGS. 1 and 2 of this disclosure as an inner upper glass panel 32 disposed in the upper portion 33 of the opening 21, an outer upper glass panel 34 disposed in a storage position parallel to the first panel and also in the upper portion 33 of the opening 21, and screen panel 35 disposed in the lower portion 36 of the opening 21. It will be appreciated that the screen panel 35 is shown in the drawings serving as a means of controlling the lower portion 36 of opening 21 by allowing air flow therethrough and screening out flies, insects, and the like; however, screen panel 35 is interchangeable with the glass panel 34 when it is desired to control the opening 21 by fully closing same against air flow therethrough.

The panels 32, 34, and 35 are held in position in the opening 21 by improved holding means of this invention; and, such holding means is designated generally by the reference numeral 37 and will be described in detail subsequently.

The panels 32 and 34 have been referred to as glass panels heretofore and in this disclosure will continue to be referred to as glass panels; however, each panel may be comprised of any suitable light-transmitting transparent or translucent material such as plastic, or the like. Each panel 32 and 34 has a glass panel designated by the reference numeral 40 which is supported about its peripheral portion employing a frame structure which in each instance is designated by the same general reference numeral 41. The frame structure 41 is made of suitable materials commonly used in the art for this purpose including metallic materials and has glazing means such as a glazing compound 42 holding each associated glass panel 40 within the frame structure 41 in a fluid-tight manner.

In a similar manner, the panel 35, which is in the form of a screen panel 35, has a suitable peripheral frame structure 43 particularly adapted to support a screen member 44. The frame structure has a peripheral recess 45 therein and wedge member 48 of U-shaped cross section serves to hold the peripheral edge portion 49 of screen 44 within the recess 45.

In this disclosure of the invention the panel 32 and panel 35 are vertically disposed in a common plane with the panel 32 being supported against horizontal movement within the dwelling 20 by surface 24 and the upper portions of surfaces 30 and the panel 35 being supported against horizontal movement within the dwelling 20 by surface 26 and the lower portions of surfaces 30. Further, to prevent outward movement of the panels 32 and 35, the holding means 37 of this invention is employed and such holding means also serves as a means of supporting the panel 34 in a storage position and such holding means will now be described in detail.

Figure 5:
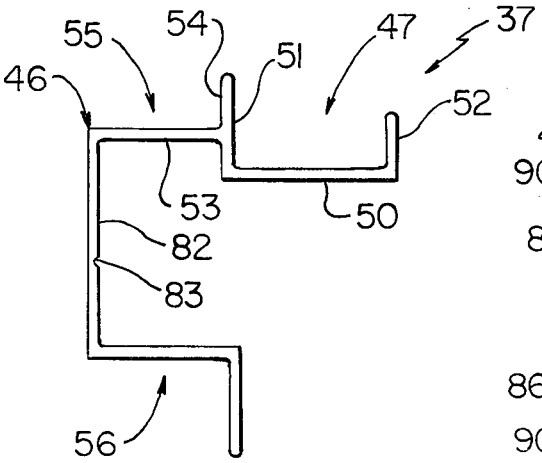
FIG. 5 is an enlarged end view of the central horizontal rail shown in FIG. 2.

As shown in FIGS. 1 and 2 the holding means 37 comprises a horizontally disposed rail 46 and as best illustrated in FIG. 5 such rail 46 has a substantially U-shaped channel 47 for receiving a lower end portion of a panel therewithin; and, in this example of the invention the panel 34 is received within U-shaped channel 47 and such channel is defined by a horizontal bight 50 and a pair of vertically disposed legs including an inner leg 51 and an outer leg 52 extending upwardly from opposite ends of the bight 50. The size of the channel 47 and in particular the length of the bight 50 and construction of the legs 51 and 52 is such that the lower end portion of the top outer panel 34 is received snugly within channel 47. The upper end portion of the outer panel 34 is held by a portion of the holding means 37 to be described subsequently.

The rail 46 has an extension 53 extending horizontally from a central part of the inner leg 51 and the horizontal extension 53 cooperates with a portion 54 of the leg 51 disposed above the horizontal extension 53 to define an L-shaped channel, which is designated generally by the reference numeral 55, for receiving the inner panel 32 therewithin. The extension 53 is dimensioned such that the outside surface of the lower part of frame structure 41 of panel 32 is engaged by extension 54 of leg 51 whereby extension 54 serves to hold the panel 32 against the upper portions of the surfaces 30 of members 27. The upper end portion of the top inner panel 32 is held by a portion of the holding means 37 as will be described subsequently.

The rail 46 also has a second L-shaped channel which is designated generally by the reference numeral 56 and is disposed in vertically aligned relation beneath the L-shaped channel 55. The channel 56 is particularly adapted to receive the upper end portion of the frame structure 43 of the panel 35 therewithin and holds such upper end portion of the frame structure 43 of panel 35 so that it engages the lower portions of the vertically disposed surfaces 30 of the members 27. The holding means 37 also comprises means for fastening the lower portion of the panel 35 in position over the lower portion 36 of opening 21 and although any suitable means may be employed for this purpose such fastening means in this example of the invention comprises a hook assembly 57 which is detachably fastened to member 25 as shown at 60. The fastening assembly 57 has a hook 61 which is adapted to be received within an eyelet 62 which is detachably threadedly received within a threaded opening 63 in the frame structure 43 of panel 35.

It will be appreciated that the panels 32, 34, and 35 are of identical size and each has a threaded opening 63 disposed in the lower part of its frame structure 41 as illustrated in each instance at 64 and each opening 63 is adapted to receive a threaded eyelet 62 therewithin. Accordingly, when the panel 34 is disposed in the lower portion 36 of opening 21 and the panel 35 is correspondingly moved to the storage position within the U-shaped channel 47, the eyelet 62 is suitably removed from the panel 35 and threaded in the threaded opening 63 in panel 34 so that the hook 61 of the fastening means or device 57 may be employed to fasten the lower portion of such panel 34, now in the lower position, in a fluid-tight manner to perform its storm panel function.

The holding means 37 comprises at least one F-shaped clip and in this example comprises a plurality of two F-shaped clips each designated by the same reference numeral 65. Each F-shaped clip 65 is particularly adapted to engage the upper portions of the panels 32 and 34 and in particular the upper portions of the upper framing members 41 supporting such panels 32 and 34 essentially in the manner illustrated in the top portion of FIG. 2.

Each F-shaped clip 65 has a leg member 66 which in this example of the invention is adapted to be disposed horizontally and fixed to the structural member 23 and the F-shaped member 65 has an outer transverse arm 67 and an inner comparatively shorter arm 70. Each clip 65 is disposed with its arms 67 and 70 perpendicular to the leg 66 thereof and the arm 70 engages and holds the inner panel 32 in position while the arm 67 cooperates with the arm 70 to receive the upper member of the frame structure 41 of outer panel 34 therewithin. It will be appreciated that once the panels 34 and 35 are interchanged the arms 67 and 70 receive the upper member of frame structure 43 therewithin while the channel 47 receives the lower member of the frame structure 43 therewithin.

As previously mentioned the panels 32, 34 and 35 are of identical size and thus of identical vertical and horizontal dimensions; and, with this construction such panels are made such that with the horizontal rail 46 installed in position and the F-shaped clips 65 installed in position the leg portion 70 of each clip 65 engages the inner panel 32 while the lower member of the frame structure 41 of panel 32 rests upon extension 53. The extension 53 is disposed horizontally from the central portion of the leg 51 whereby, in essence, the bottom member of the frame structure 41 of panel 34 is disposed beneath the bottom surface of the lower member of the frame structure 41 with a vertical distance 71 therebetween. There is also a vertical distance or gap 72 between the upper member of the frame structure 41 of the outer panel 34 and the leg 66 of the F-shaped clip 65 and the distance 72 is greater than the distance 71. The dimensions of the clips 65 and leg portion 52 of U-shaped channel 47 of rail 46 are such that the outer panel 34 may be lifted vertically to a position indicated by dotted lines 73 and the lower portion of panel 34 tilted outwardly, as indicated by the arrow 74, enabling the inside surface of the lower member of the frame struction 41 to be moved past leg 52 enabling the outer upper panel 34 to be slid vertically downwardly and removed from the storage position. The reverse procedure is employed to install either the panel 35 in the storage position or to reinstall the outer panel 34 in such storage position once it is desired to return the panel 35 in the lower portion 36 of the opening 21.

It will also be seen that the identical vertical dimension of each panel 32, 34, and 35 is such that a space 75 is defined between the top surface of the upper member of the frame structure of each of such panels when each panel is in the lower portion 36 of opening 21. The space 75 enables sufficient vertical movement of each panel being installed within the L-shaped channel 56 and thereby facilitates both installation and removal thereof.

Each F-shaped clip 65 has a countersunk opening 76 defined in its leg portion 66 and such countersunk opening 76 is particularly adapted to receive a flat head screw 77 therethrough so that the outside surface of the head of such screw 77 is substantially coplanar with the inside surface of the leg 66 of clip 65.

The holding means 37 also includes a pair of threaded screws 80 each disposed through an associated opening 81 in the rail 46 and the openings 81 are provided at opposite end portions of the rail 46. The screws 80 are suitably threadedly fastened to framing members 27 and hold the horizontal rail 46 in position at its opposite ends.

As will readily be apparent from FIG. 5 of the drawing the L-shaped channel 56 extends from a vertical extension or web 82 which extends from the inner end of the extension 53. The vertical extension 82 is disposed parallel to the legs 51 and 52 and it will be seen that rail 46 with its integral U-shaped channel 47, L-shaped channel 55, L-shaped channel 56, and extension 82 is a single-piece structure.

The extension 82 has a groove 83 of V-shaped cross-sectional outline extending horizontally across the full length thereof and thus across the full length of the rail 46. The groove 83 is particularly adapted to help confine a drill, or the like, against vertical movement during drilling action and during the process of drilling openings 81 within rail 46. The F-shaped clip 65 is also provided with a similar V-shaped groove for a similar purpose and such groove is not shown because it is disposed behind the screw 77 in FIG. 2.

Figure 6:
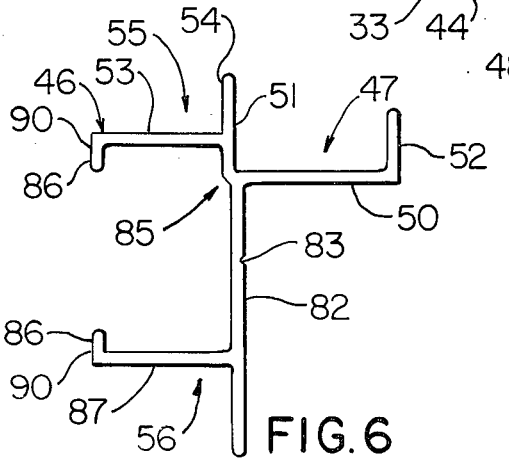
FIG. 6 is a view similar to FIG. 5 illustrating another exemplary embodiment of a horizontal rail which may be used interchangeably with the rail of FIG. 5.
Figure 4:
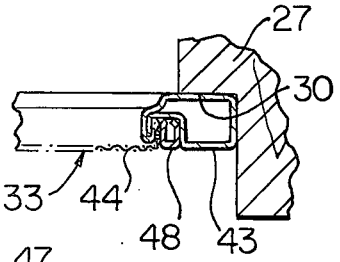
FIG. 4 is a cross-sectional view with portions broken away taken essentially on the line 4—3 of FIG. 1.

A modification of the horizontal rail 46 is illustrated in FIG. 6 of the drawing; and, in such modification instead of having a vertical extension or web 82 disposed beneath the terminal end of the extension 53, a vertical web also designated by the reference numeral 82, is disposed substantially vertically beneath the inner leg 51 of the U-shaped channel 47 as shown at 85. Practically all of the other component portions of the rail 46 of FIG. 6 are substantially identical to corresponding component portions of the rail 46 of FIG. 5, except for a pair of projections 86 which will now be described and have been designated by the same reference numerals as previously.

One of the projections 86 extends downwardly from an inner end of extension 53 and the other projection 86 extends upwardly rom a horizontal leg 87 of the L-shaped channel. The projections 86 have coplanar outside bearing surfaces 90 adapted to engage surfaces 30 of members 27 upon fastening the rail 46 of FIG. 6 in position. As before, the rail 46 of FIG. 6, with all its component portions, is a single piece structure; and, the web 82 thereof also has a groove 83 disposed horizontally therealong for the same purpose previously described.

Each horizontal rail 46 whether of the type shown in FIG. 5 or in FIG. 6 and the substantially F-shaped clips may be made employing any suitable technique known in the art, and in this example of th invention such components are preferably made by extrusion process. In addition, it will be appreciated that components may be made employing any suitable material known in the art; however, such members are preferably made of aluminous materials.

It will also be appreciated that the panels 32, 34, and 35 are sized so that they readily fit within opening 21, and with the vertical spaces 75, 71, and 72 being provided for the previously described purposes.

While present embodiments of this invention, and methods of practicing the same, have been illustrated and described, it will be recognized that this invention may be otherwise variously embodied and practiced within the scope of the following claims.

What is claimed is:

1. In a window construction comprising; peripheral framing members including an upper member having a vertically disposed supporting surface, a lower member having a vertically disposed supporting surface, and a pair of spaced parallel side members connected between opposite ends of said upper and lower members with each side member having a vertically disposed supporting surface, said peripheral framing members defining an opening in said construction with said vertical surfaces being disposed in a common plane; a plurality of three panels disposed within said opening; and means holding said panels within said opening; the improvement wherein said holding means comprises; a horizontally disposed rail having a substantially U-shaped channel for receiving a lower end portion of a first panel therewithin, said U-shaped channel being defined by a horizontal bight and a pair of vertically disposed legs including an inner leg and an outer leg extending from opposite ends thereof, an extension extending horizontally from a central part of said inner leg, said horizontal extension cooperating with a portion of said inner leg thereabove to define a first L-shaped channel for receiving a second of said three panels therewithin, said rail also having a second L-shaped channel disposed beneath said first L-shaped channel and adapted to receive a third panel therewithin; and at least one substantially F-shaped clip adapted to engage and hold upper portions of said first and second panels within said opening.

2. In a window frame construction as set forth in claim 1 the further improvement wherein said rail of said holding means has a vertically disposed web connected between said horizontal extension and said second L-shaped channel.

3. In a window frame construction as set forth in claim 2 the further improvement wherein said rail of said holding means has said web disposed beneath the terminal end of said horizontal extension.

4. In a window frame construction as set forth in claim 2 the further improvement wherein said rail of said holding means has said web disposed substantially vertically beneath said inner leg of said U-shaped channel.

5. In a window frame construction as set forth in claim 2 the further improvement wherein said holding means further comprises a roughly V-shaped groove in said web extending longitudinally therealong, said groove being defined by opposed side surfaces which are adapted to help hold an instrument used to form holes in said web against movements transverse said side surfaces.

6. In a window frame construction as set forth in claim 2 the further improvement wherein said F-shaped clip of said holding means comprises a leg and a pair of transverse arms, said arms being disposed in parallel relation perpendicular to said leg.

7. In a window frame construction as set forth in claim 6 the further improvement wherein said holding means further comprises a roughly V-shaped groove in said leg extending longitudinally therealong, said groove being defined by opposed side surfaces which are adapted to help hold an instrument used to form holes in said leg against movements transverse said side surfaces.

8. In a window frame construction as set forth in claim 2 the further improvement wherein said rail of said holding means is made of aluminous material.

9. In a window frame construction as set forth in claim 2 the further improvement wherein said rail of said holding means is an extruded rail.

10. In a window frame construction as set forth in claim 2 the further improvement wherein said F-shaped clip of said holding means is made of an aluminous material.

11. In a window frame construction as set forth in claim 2 the further improvement wherein said holding means further comprises a plurality of fasteners detachably fastening opposite end portions of said rail to said pair of spaced side members.

12. In a window frame construction as set forth in claim 2 the further improvement wherein said holding means further comprises at least one fastener detachably fastening said F-shaped clip to said upper member.

13. A storm and screen panel supporting rail adapted to be installed horizontally in a window construction to support a plurality of three panels, said rail comprising, a substantially U-shaped channel for receiving a lower end portion of a first panel therewithin, said U-shaped channel being defined by a horizontal bight and a pair of vertically disposed legs including an inner leg and an outer leg extending from opposite ends thereof, an extension extending horizontally from a central part of said inner leg, said horizontal extension cooperating with a portion of said inner leg thereabove to define a first L-shaped channel for receiving a second of said three panels therewithin, and a second L-shaped channel disposed beneath said first L-shaped channel and adapted to receive a third panel therewithin.

14. A rail as set forth in claim 13 and further comprising a vertically disposed web connected between said horizontal extension and said second L-shaped channel.

15. A rail as set forth in claim 14 wherein said web is disposed beneath the terminal end of said horizontal extension.

16. A rail as set forth in claim 14 wherein said web is disposed substantially vertically beneath said inner leg of said U-shaped channel.

17. A rail as set forth in claim 14 in the form of a single-piece structure of extruded aluminous material.

18. A rail as set forth in claim 14 and further comprising a roughly V-shaped groove in said web extending longitudinally therealong, said groove being defined by opposed side surfaces which are adapted to help hold an instrument used to form holes in said web against movements transverse said side surfaces.

* * * * *